US005879241A

United States Patent [19]

Cook et al.

[11] Patent Number: 5,879,241

[45] Date of Patent: Mar. 9, 1999

[54] MATCHED SET OF GOLF CLUBS AND METHOD OF PRODUCING THE SAME

[76] Inventors: Eric H. Cook, 1234 Erindale Drive, Ottawa, Canada; Michael A. Atkinson, 25 Lake Shore Dr., Pinehurst, N.C. 28374

[21] Appl. No.: 811,371

[22] Filed: Mar. 4, 1997

[51] Int. Cl.[6] ..... A63B 53/00

[52] U.S. Cl. ..... 473/289; 473/291; 473/292; 473/297; 473/409

[58] Field of Search ..... 473/287, 289, 473/290, 291, 292, 409, 297

[56] References Cited

U.S. PATENT DOCUMENTS

| | | | |
|---|---|---|---|
| 1,516,786 | 11/1924 | Prentiss | 473/292 |
| 3,395,571 | 8/1968 | Murdoch | 473/289 |
| 3,473,370 | 10/1969 | Marciniak | 473/291 |
| 3,698,239 | 10/1972 | Everett, III . | |
| 3,871,649 | 3/1975 | Kilshaw . | |
| 4,070,022 | 1/1978 | Bradly . | |
| 4,128,242 | 12/1978 | Elkins | 473/291 |
| 4,461,479 | 7/1984 | Mitchell | 473/292 |
| 4,555,112 | 11/1985 | Masghati | 473/289 |
| 4,674,324 | 6/1987 | Benoit | 473/291 |
| 5,295,686 | 3/1994 | Lundberg | 473/291 |
| 5,379,641 | 1/1995 | Paaisvaara | 473/289 |

*Primary Examiner*—Sebastiano Passaniti
*Assistant Examiner*—Stephen L. Blau
*Attorney, Agent, or Firm*—Carnes Cona & Dixon

[57] ABSTRACT

The present invention provides a matched set of golf clubs, wherein each club in a set of golf clubs, irons, woods, or a combination thereof, provides the golfer with precisely the same feel, related to the golfer's swing when the club is swung, and to the contact between the head of the club and golf ball when the ball is hit. In the present invention the clubs are matched dynamically. The clubs will have one or all of the following characteristics: (1) a constant flexural rigidity of each complete iron and/or each complete wood, (2) a constant moment of inertia, and (3) a the center of gravity which is calculated by using a constant force for the shortest club in the set.

17 Claims, 2 Drawing Sheets

MATCHED SET OF GOLF CLUBS AND METHOD OF PRODUCING THE SAME

BACKGROUND OF THE INVENTION

1. Field of the Invention

The present invention relates generally to providing a matched set of golf clubs or flexurally momentized golf clubs and more particularly to a set of golf clubs that all have the same feel when used by a golfer by rendering each club with the same flexural rigidity, substantially the same moment of inertia, and calculated varying center of gravity, all of which are matched to the specific swing of the golfer who will use them.

2. Description of the Prior Art

For years, golfers have relentlessly tried to improve their game by searching for the ideal set of clubs wherein each club "feels" the same and performs in a consistent manner. As such, numerous methods have been formulated in the attempts of dynamically matching the set of golf clubs While many systems have been developed that match one club in a set to the other clubs in the same set, no one has developed a method of precisely determining the specific requirements of the individual golfer and producing a properly matched set of clubs that meet these requirements, which is the basic purpose of the present invention.

One such method for matching golf clubs in a set is to provide the set with the same moment of inertia with respect to a common swinging axis. Such a method is disclosed in U.S. Pat. No. 3,698,239 issued to Everett, III. These methods use the assumption that having identical moments per club will inherently provide the golfer with better feel and more control. Though the determination of the moment of inertia is important in dynamically matching clubs, it is not the only element needed for optimum control for the golfer. In fact, these methods fail to discuss the flexural rigidity, which is the stiffness of the shaft of the golf club. For a golfer to adequately "feel" that the clubs are matched, this flexural rigidity must be the same throughout a set of irons and woods. Unfortunately, with the methods discussed above, as the shaft shortens, the flexural rigidity increases. Hence, providing for a set of clubs which are not matched to the user correctly; but are instead, matched to each other.

Other methods have been provided for improving the golfer's game by adjusting the shaft of the golf club, wherein the shafts of each set of clubs is provided with the same frequency. Such as the method disclosed in U.S. Pat. No. 3,871,649 issued to Kilshaw and U.S. Pat. No. 4,070,022 issued to Braly. In both of these patents, the shafts of the clubs are provided with identical frequencies. The measurements are accomplished without the heads of the clubs being attached thereto. Once the heads are attached, weight is added to the shaft. This will inherently provide for the frequency to alter per club, thereby providing for clubs having different frequencies.

Hence, it is seen that none of these previous efforts provide the benefits intended with the present invention, such as providing a set of golf clubs which feel matched by the user. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides a matched set of golf clubs, wherein each club in a set of golf clubs, irons, woods, or a combination thereof, provides the golfer with precisely the same feel, related to the golfer's swing when the club is swung, and to the contact between the head of the club and golf ball when the ball is hit.

In order to accomplish this correct feel and to provide for the clubs to be matched dynamically, three criteria of each club must be equated; specifically, (1) a constant flexural rigidity of each complete iron and each complete wood, (2) the selected moment of inertia, and (3) the precise location of the center of gravity's for each club in the set.

The single most important element of a golf club is the stiffness of the shaft which is used for constructing the club. This stiffness, also known as the flexural rigidity, must be constant throughout a particular set (i.e. irons, woods, or a combination thereof) for providing consistency in performance from the clubs. For determining the optimum flexural rigidity for any shaft, the user or golfer of the club uses a flexural rigidity test means. This test means allows the user to determine the appropriate stiffness of the club for their particular swing. This correct stiffness provides the best feel and most consistent results. The proper feel obtained by the golfer in combination with the structure of the club will work simultaneously for improving one's game in golf.

In order to obtain maximum distance from any golf club, a golfer must be fitted with the maximum head weight with which they can generate the maximum club head speed. For determining this maximum head weight, the moment of inertia about the golfer's wrist is mathematically calculated. Once calculated, the clubs are adjusted accordingly by providing the proper head weight per club.

The final step in customizing the set of clubs is to establish a more ideal center of gravity for each club. Such an adjustment of the center of gravity will render a club which will perform in a constant manner and will additionally provide constant feel between each club.

Accordingly, it is the object of the present invention to provide for a matched set of clubs and method of producing the same which will overcome the deficiencies, shortcomings, and drawbacks of prior dynamically matched golf club sets and methods thereof.

It is another object of the present invention to provide for a matched set of clubs, wherein each club in the set provides the golfer with precisely the same feel.

Yet another object of the present invention is to replace the shafts of an existing set of golf clubs so as to allow each club of the set to have the same feel.

Still another object of the present invention, to be specifically enumerated herein, is to provide a matched set of clubs in accordance with the preceding objects and which will conform to conventional forms of manufacture, be of simple construction and easy to use so as to provide clubs that would be economically feasible, long lasting, properly customized and relatively trouble free in operation.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
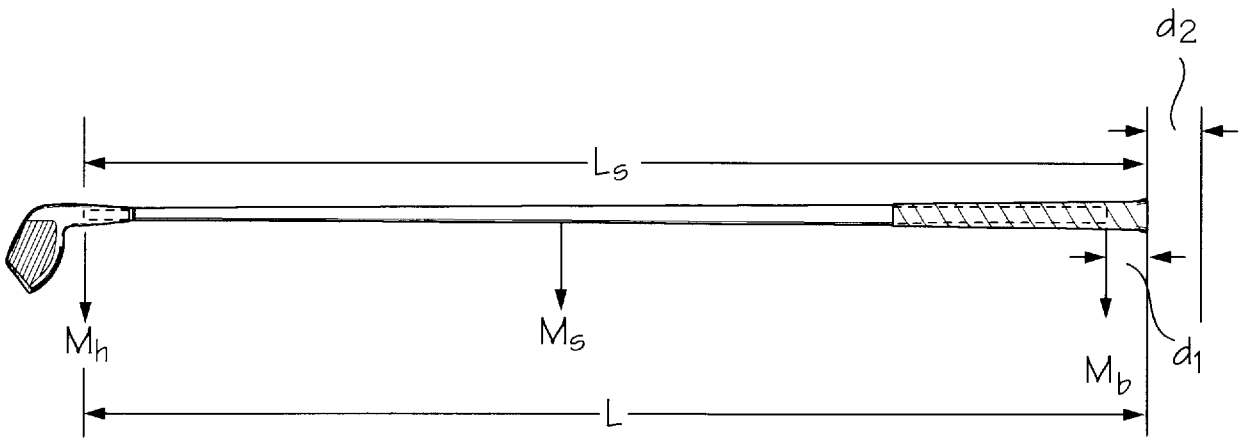
FIG. 1 is a diagrammatic side view of a golf club illustrating the parameters used in calculating the moment of inertia.
Figure 2:
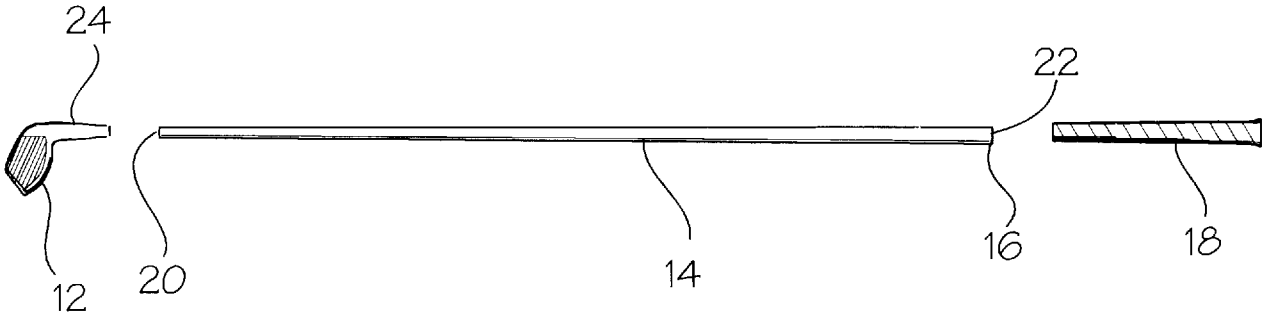
FIG. 2 is a side view of the components of a golf club prior to assembly.

The present invention provides a set of golf clubs, such as irons, woods, or a combination thereof, which are synchronized for matching the particular swing of a particular golfer. This will provide for a set of customized clubs which will inherently improve the game of the user.

As seen in the drawings, a golf club 10 is provided with a head 12 having a head weight $M_h$, a shaft 14 having weight $M_s$. The shaft 14 further includes a tip or first end 20 and a butt end 16. A grip 18 is attached to the butt end 16 and a hosel 24 of the head 12 is attached to the first end 20 of the shaft 14. The weight of the grip plus any additional weight added to the end of the shaft has a weight has a weight $M_b$. The golf club 10 further includes a total length L which encompasses the head and shaft. The shaft 14 includes a shaft length $L_s$ which encompasses the tip or first end 20 and the butt end 16.

For optimizing the performance of the golfer, three characteristics of the conventional golf club are taken into consideration. These three characteristics include: (1) a constant flexural rigidity of each complete iron within a set of irons and each complete wood within a set of woods, (2) a constant moment of inertia for each iron and each wood, and (3) the center of gravity as it relates to the swing of the individual golfer. Thereby, providing for a set of flexurally momentized golf clubs. The determination of each characteristic is discussed as follows:

Flexural Rigidity

Flexural rigidity relates to the stiffness of the shaft of a particular golf club. To maintain a constant frequency, the flexural rigidity of the completed club must remain constant. Accordingly, within each set of clubs, the frequency must be the same. Hence, each club in the set of irons will have the same flexural rigidity and each club in a set of woods will have the same flexural rigidity. However, the flexural rigidity between the irons and woods may not necessarily be the same.

The process for providing a set of golf clubs with the same flexural rigidity is of the utmost importance. In order to accomplish this, the shaft, including the head, provides for the particular club to have the same frequency. The shaft, without the head, may not have the equivalent frequency of the other clubs in the set. It is the combination of the head and shaft which makes up the equivalent frequencies, thereby providing one of the aspects for making each club in a set to have the same feel.

For providing this equivalent frequency per club, the shaft, in combination with the head, is placed on a conventional frequency analyzer at the desired length L. The frequency is measured. If the measurement is not the desired frequency, the head is removed and the tip or first end 20 of the shaft 14 is cut. This cutting of the tip or first end 20 will alter the frequency, making it stiffer. The head 12 is then placed on the shaft 14, the desired length L is reestablished, and the club is reattached onto the frequency analyzer. The test is performed again and the process of removing the head 12, cutting the tip or first end 20, measuring the length L, reattaching the head 12 to the tip or first end 20, and reattaching the club 10 to the analyzer is repeated until the desired frequency is obtained. All cutting is done at the tip or first end 20 of the conventional shaft. All frequency measurements are accomplished with the head 12 attached to the shaft 14. No cutting is performed on the butt end 16 of the shaft until after the required frequency is obtained, the shaft is then butt cut to provide the desired playing length L for the club. This playing length L must be established before the frequency is measured and must be reset each time the tip or first end 20 is cut.

The process described above is continued with each club per set. The frequency of each club, with the head attached thereto, in a set of irons is within the range of 260 to 345 cycles per minute, while the frequency of each club, with the head attached thereto, in a set of woods is within the range of 230 to 300 cycles per minutes. It is noted that within each set of clubs, the frequency may be off by approximately plus or minus 1 cycle per minute, due to the added weight of the conventional attaching means for securing the head to the tip or first end of the shaft. However, this additional weight provides for such a minute alteration in the frequency that the actual feel for the user of the club is not affected. It is further noted that since the frequency may be off by approximately plus or minus 1 cycle per minute, then the moment of inertia will inherently also be off within the range as specified above. The alteration of the plus or minus 1 cycle, in addition to the added weight done for determining the center of gravity is such that it does not significantly alter or effect the frequency. The alterations provide for the frequency to be within the ranged as identified above. This added weight, for consideration of frequency is typically insignificant but is of the utmost importance when establishing the center of gravity. It is noted that the only way to effect the frequency of a particular club is by tip cutting.

For determining the appropriate frequency or flexural rigidity for a particular golfer, a set of preset test clubs is used. These preset test clubs have the same pre-selected head weight, within their respective set or units, shaft weight, swing weight, moment of inertia, grip size and total weight. Having the same head weight within their respective set or unit will provide for, as way of an example, all seven irons to have the same head weight and as a second example, all five irons will have the same head weight. The only variable with these test clubs is the frequency. Typically and preferably, the 7 irons, 5 irons, and drivers are used in testing. Accordingly, each test club is built to a predetermined frequency such that the set of test clubs covers the full range of available frequencies. The difference in frequency from one test club to another should not exceed 5 cycles per minute.

Hence, for the determination of flexural rigidity, the golfer hits a series of balls with the preset set of test clubs. The frequency is chosen by the user from the club which felt the best and produced the best results. Throughout the years, frequency will not change with the golfer, regardless of age or experience. This is why the correct frequency will inherently produce the best results as well as provide a club which feels proper. The club which does both, from the preset test set, determines the frequency for the golfer. This method will allow precise determination of the frequency or flexural rigidity. If the user cannot decide between two separate frequencies with two separate clubs, i.e. 290 cycles per minute (cpm) with the 7 iron or 285 cycles per minute (cpm) with the 5 iron, then the test clubs can be choked, via conventional methods, for stiffening and increasing the frequency, for inherently determining the precise frequency. Each ¼ inch choke down is equivalent to an approximate increase of 2 cycles per minute (cpm). An example for this type of situation is discussed below in example 3. Other methods, such as allowing the golfer to draw or fade the ball can also be utilized in combination with the choking process, when the golfer has selected two separate frequencies for two separate clubs. This situation is discussed below in example 4.

Moment of Inertia

For determining the moment of inertia, the user hits with preset test clubs. These preset clubs have predetermined set shaft stiffness and frequency. Ideally, the golfer should be fitted with the heaviest head that will provide the highest speed. Testing has shown that the ideal moment of inertia is directly related to the club head speed accomplished by the golfer during testing (Tables I and II are used when test clubs are not available).

Through years of testing various golfers of diverse skill levels, tables, labeled as Table I (for men) and Table II (for women), have been formulated. For tabulating the tables, a random selection of at least 900 people (at least 800 men and at least one hundred women) were tested. The testers took a series of golf clubs, having varying head weights, and hit a series of golf balls. The results were plotted on a graph of speed versus head weight. From the graph it was determined the best head weight to be used for a particular speed. The tables illustrate the results, which are used as standardized tables for men and women.

TABLE I

TABULATION FOR MEN

| Speed (MPH) utilizing a Driver | Distance (Yards) utilizing a 5 Iron | Swing Weight Maximum | Swing Weight Ideal |
|---|---|---|---|
| 110 and up | 205 and up | C5 | C2–C3 |
| 105–110 | 200–205 | C6 | C3–C4 |
| 100–105 | 190–200 | C7 | C4–C5 |
| 95–100 | 180–190 | C8 | C5–C6 |
| 90–95 | 170–180 | C9 | C5–C6 |
| 85–90 | 160–170 | C9 | C6–C7 |
| 80–85 | 150–160 | D0 | C7–C8 |
| 75–80 | 140–150 | D0 | C8–C9 |
| 70–75 | 130–140 | D0 | C8–C9 |
| under 70 | 120–130 | D0 | C9–D0 |

TABLE II

TABULATION FOR WOMEN

| Speed (MPH) utilizing a Driver | Distance (Yards) utilizing a Driver | Swing Weight Maximum | Swing Weight Ideal |
|---|---|---|---|
| 95–100 | See Men's Chart | | |
| 90–95 | See Men's Chart | | |
| 85–90 | See Men's Chart | | |
| 80–85 | 180–190 | C5 | B7–B9 |
| 75–80 | 170–180 | C6 | B9–C2 |
| 70–75 | 160–170 | C7 | C2–C4 |
| 65–70 | 150–160 | C8 | C4–C6 |
| 60–65 | 140–150 | C9 | C6–C8 |
| 55–60 | 130–160 | C9 | C7–C8 |
| 50–55 | 120–130 | C9 | C7–C8 |
| 45–50 | 110–100 | C9 | C7–C8 |
| 40–45 | 100–110 | D0 | C8–C9 |

It is noted that the notation s for swing weight matching, as indicated in the columns above in Tables I and II, are used universally today. As is standard, the weight distribution of each club of a designated set is completely specified. The balance arm of the conventional swing weight matching scale has alphabetically designated major divisions which are subdivided into numerical tenths so that the position of the poise on the balance arm has an alphanumeric designation such as C8, D0, etc. The balance position of the poise is the same for each club of the swing weight matched and the set is identified by the alphanumeric designation of this poise position. This alphanumeric designation is conventional, but will be used hereinafter to refer to the desired moment of inertia.

For testing in determining the correct flexural rigidity, the golfer hits a series of balls with the test clubs. During the hitting process, the golfer then selects the one club which provides the best feel and the best results in terms of distance, trajectory and direction of each shot. This will determine the frequency which is necessary for each set.

During the testing, the club head speed and/or distance is established. For testing speed, conventional machinery, such as a Swing Analyzer, produced by GOLFTEK, Inc., is used. For testing distance, a conventional driving range can be utilized.

Once the golfer has selected the best "felt" golf club in combination with the club that resulted in the best hit, the flexural rigidity is established; then using Table I or Table II, the swing weight is established. It is noted that the term "swing weight" is known in the field of golf. This swing weight is used in this invention for providing the selected moment of inertia.

In order to obtain maximum distance from any golf club, a golfer must be fitted with the maximum headweight with which he can generate the maximum clubhead speed. Once the clubhead speed is established, either by the use of a conventional swing analyzer or the use of the Tables above, and the ideal moment of inertia is selected (labeled as the swing weight in the Tables above), the headweight for each club in the set can be precisely calculated to plus or minus 0.1 grams using the following formula for the moment of inertia:

$$MI = M_h(L + d_2)^2 + \frac{1}{3} M_s L_s^2 + \frac{4}{3} M_s L_s + \frac{4}{3} M_s + M_b(d_1 + d_2)^2 \quad (1)$$

where

MI=Selected Moment of Inertia (gm in$^2$)

$M_h$=Mass of the head (grams)

L=Playing length of the club (in)

$M_s$=Mass of the shaft (grams)

$L_s$=Cut length of the shaft (inches)

$M_b$=Mass added to the butt end including the grip and any weight required to located center of gravity (grams)

$d_1$=Distance from the center of $M_b$to the butt end of the grip $d_2$=Point above the end of the butt of the club used as the axis of rotation for the calculation of the moment of inertia.

Using equation (1) as defined above, the mass of the head can be solved by:

$$M_h = \frac{MI - 1/3\, M_s L_s^2 - 4/3\, M_s L_s + 4/3\, M_s + M_b(d_1 + d_2)^2}{(L + d_2)^2} \quad (2)$$

All the elements are known. For the calculation of this equation $d_1$ and $d_2$ can be assumed to be 2 inches. The respective head weights of the other golf clubs of the particular determined moment of inertia (swing weight) are then readily calculated.

Once calculated, the clubheads to be used are weighted to correspond to the calculated value for each club in the set. Using these weighted heads, the shafts are cut, as described above, to provide the designated flexural rigidity for each club in the set. The heads are then fixed to the corresponding shafts so that the final step, determining the center of gravity, can be completed.

Center of Gravity

Figure 3:
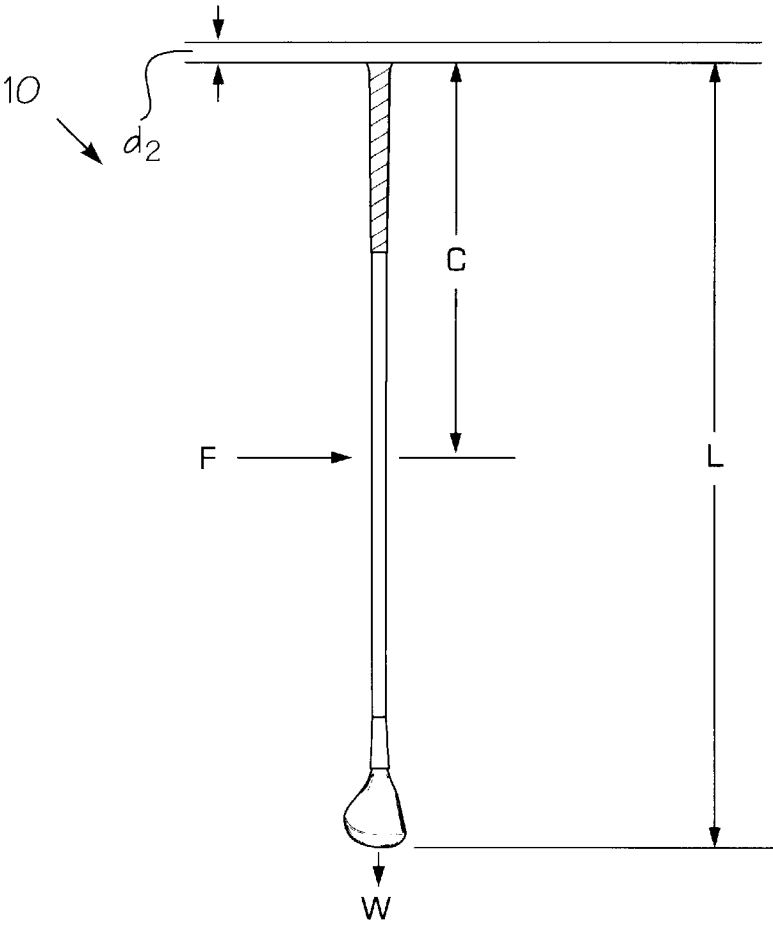
FIG. 3 is a diagrammatic side view of a golf club illustrating the parameters used in calculating the center of gravity for each club.

In order to support the theory of consistent feel throughout a set of clubs, the center of gravity of each club must be set. The center of gravity of each club relates to the head weight, length, and force as applied by the golfer during the swing. As seen in FIG. 3, the center of gravity C for the clubs should be based on the amount of applied force F being a constant. Using the ideal club 10 as the base, which is typically the shortest club in the set, the force required to move the club can be calculated using the following equation:

$$FC = WL_1 \quad (3)$$

wherein:

F=Force applied by the golfer

C=Distance to center of gravity from the butt end of the selected shortest club

W=Total weight of head and shaft $L_1$=Club length L plus $d_2$ $d_2$=Point above the end of the butt of the club used as the axis of rotation The point above the end of the butt of the club used as the axis of rotation ($d_2$) can be assumed to be 2 inches. Equation (3) can be rewritten for representing the Force by the following equation:

$$F = \frac{WL_1}{C} \quad (4)$$

Figure 4:
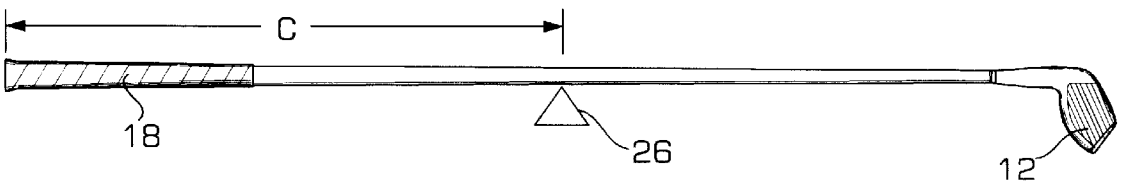
FIG. 4 is a side view of a golf club in a balance state and illustrating the center of gravity.

The force is calculated for the base club. The base club is the shortest club of a set. Normally, for irons it is the wedge or 9 iron, while for woods it is the 5 wood or the shortest wood to be made. Accordingly, it is seen that total weight of the head and shaft is known (W), the total length of the club (L) plus the point above the end of the butt end of the club used as the axis of rotation ($d_2$) will give the known value for ($L_1$) wherein ($d_2$), if not measured, can be assumed to be two inches. The center of gravity C is measured for the shortest club. In order to do so, as seen in FIG. 4, the club 10 is placed on a conventional pedestal 26. If the club is leaning in a particular direction, or a first direction, the club is shifted in the opposite direction, or a second direction. The club is observed again to see if it is in balance or if it is leaning. If it is leaning, the club is shifted as discussed above. This process is repeated until the club is balanced on the pedestal. Once a balance or an equilibrium is achieved with the club at rest on the pedestal, a measurement is taken. This measurement C, as seen in the drawings, is taken from the butt end of the club to the point on the club which rests on the pedestal 26. This is known as the center of gravity (C). The force (F) can be calculated. Once the force has been established for the base club, the formula, as written in equation (4) is rewritten so that the center of gravity can be calculated for the clubs in the set, based on the force calculated for the base club. This equation for the center of gravity is defined as follows:

$$C_n = \frac{W_n L_n}{F} \quad (5)$$

wherein:

F=Calculated Force applied by the golfer on the shortest or base club $C_n$=A calculated measurement establishing a distance from the butt end of club n of the set to the center of gravity of club n $W_n$=Total weight of head and shaft of club n $L_n$=The total length (L) of the club n plus $d_2$ This will allow for the center of gravity to be calculated for the rest of the clubs for n being the consecutive or particular club in the set. As the rest of the clubs are gripped, the center of gravity is set by adding the appropriate weight to the butt end of the club via conventional means as necessary to establish the center of gravity in the required location relative to the butt end of the club. Hence, the calculated $C_n$ is the distance from the butt end of the club to the point on the club which will rest on the pedestal. If the club is leaning or tilting, appropriate weight is added, until the club is balanced on the pedestal.

This procedure has been found to provide the same feel to each club in the set while the constant frequency of shafts provides more consistent performance. Hence, it is seen that the center of gravity is inversely proportional to a force generated by the swing of a golfer.

The method for providing a matched set of clubs by providing equivalency between flexural rigidity, moment of inertia, and center of gravity as defined below, is to first determine the appropriate flexural rigidity and then the moment of inertia for the user by utilizing Table I or Table II as discussed above.

Hence, the golfer hits with preset test clubs from which the individual selects the club which feels the best and which provides the best results. During this test either the person's club head speed (of the driver) or the distance that they hit (the 5 iron) can be established.

EXAMPLES

Determination of Flexural Rigidity and Moment of Inertia

Example 1

A male golfer, who limits playing golf to approximately three to four times a month, hits a series of golf balls with a preset set of test clubs using the driver. The golfer felt that the test club having the precise frequency of 265 cycles per minute felt the best and provided the best results. His clubhead speeds were recorded at 79, 80, 82, and 83 MPH. Using Table 1 it is seen that ideal swing weight or moment of inertia would be a C7.

Example 2

A male golfer, who is a semi-professional, hits a series of golf balls with clubs from a preset set using the driver. The golfer felt that the test club having the precise frequency of 270 cycles per minute felt and performed the best. His clubhead speeds were recorded at 110, 112, 115, and 111 mph. Using Table 1, it is seen that the ideal swing weight or moment of inertia would be a C2. However, since this is a semi-professional golfer, the maximum swing weight or moment of inertia would be more beneficial. Hence, a C5 would be used.

Example 3

A female golfer, who plays regularly two to three times per week, hits a series of golf balls with a preset set of test clubs using the 7 irons and 5 irons. On completion of the test she has selected a 7 iron with a frequency of 290 cpm and a 5 iron with a frequency of 285 cpm. She then hits the 285 cpm 5 iron with a ¼ inch choked down grip, to shorten the club and stiffen the shaft, and finds the results and feel to be better than either of the first frequencies selected. She then hits the 285 cpm 7 iron choked down the same amount and confirms the feel and results are better. By this added process, the ideal frequency is established as 287 cpm. She then hits the 255 cpm driver choked down ¼ of an inch and finds the feel and performance to be very good. During this test the driver speed is recorded as 66, 65, 67, 63 mph and from Table II, her ideal swing weight or moment of inertia is seen to be C6.

Example 4

A right handed male golfer, who is a low handicap player hits a series of golf balls with a preset set of test clubs using the 7 and 5 irons. On completion of the test he has selected a 300 cpm 7 iron and a 295 cpm 5 iron. As cited in example 3, this indicates that his ideal frequency is between 295 and 300 cpm. To determine the precise frequency required, he is asked to draw (move right to left) the ball and to fade (move left to right) the ball in order to determine the best club. During this test the 295 cpm clubs (5 and 7 irons) both cause the ball to draw more than desired and produce only a slight fade. This indicates to the tester that the shaft frequency is too low. Similarly the 300 cpm 7 and 5 irons produce a very slight draw and an excessive fade. By choking down ¼ inch with the 295 cpm 7 and 5 irons he finds that he can control both the fade and the draw and finds that both clubs feel better. The ideal frequency is determined to be 297 cpm. During this second phase of the test it is noted that the average distance obtained with the 5 iron is 195 yards. From Table I his ideal swing weight or moment of inertia is C5.

Example 5

A 60-year-old male golfer, who plays regularly, hits a series of golf balls with a preset set of test clubs using the 7 and 5 irons. From the test the golfer indicated that the 305 cpm test clubs performed and felt better and selected 305 cpm as his preferred frequency. Subsequent testing with the drivers recorded clubhead speeds that averaged 83 mph. From Table I, his ideal swing weight or moment of inertia is C8.

Example 6

A 24-year-old male assistant professional hits a series of golf balls with a preset set of test clubs using the 7 and 5 irons. From the test he indicated that his preferred frequency was 295 cpm. Clubhead speed tests with the drivers record an average speed of 109 mph. From Table I, his ideal swing weight or moment of inertia is C4, which he used with great success.

EXAMPLES

Determination of Center of Gravity for a set of Golf Clubs

Example 7

Tabulated below is the recorded data for determining the center of gravity. The head weight and flexural rigidity has previously been determined. The club numbers (#), playing length, head weight, and shaft weight are all known elements. For determining the center of gravity for each club, ($L_1$) must be used. This length is defined as the length of the club (L) plus the distance to the point above the end of the butt end of the club used as the axis of rotation ($d_2$). For the purpose of this example, $d_2$ is assumed to be two inches. Thereby, ($L_1$) is also a known element. Accordingly, the center of gravity can easily be calculated for a set of clubs. The first step, however is to determine the force for the shortest club in a set. In the case of irons, this would be the 9 iron. The center of gravity for this 9 iron was measured at 28 inches.

Therefore, the force F, measured in grams, can be calculated as shown below:

| Club # (irons) | Playing Length L (inches) | $L_1 = L + d_2$ (inches) | Head weight $M_h$ (grams) | Shaft weight $M_s$ (grams) | Total weight $W = M_h + M_s$ (grams) | Force $F = WL_1/C$ C = 28 in (grams) |
|---|---|---|---|---|---|---|
| 9 | 35 | 37 | 302.0 | 67.64 | 369.64 | 488 |

Knowing the force F, the rest of the centers of gravity can be calculated for the irons. These calculations are shown below:

CALCULATION FOR CENTERS OF GRAVITY FOR IRONS

| Club # (irons) | Playing Length L (inches) | $L_1 = L + d_2$ (inches) | Head weight $M_h$ (grams) | Shaft weight $M_s$ (grams) | Total weight $W = M_h + M_s$ (grams) | Center of Gravity $C = WL_1/F$ (inches) |
|---|---|---|---|---|---|---|
| 8 | 35.5 | 37.5 | 292.9 | 68.63 | 361.53 | 27.7 |
| 7 | 36 | 38 | 284.2 | 69.62 | 353.82 | 27.6 |
| 6 | 36.5 | 38.5 | 275.8 | 70.60 | 346.40 | 27.5 |
| 5 | 37 | 39 | 267.7 | 71.60 | 339.30 | 27.1 |
| 4 | 37.5 | 39.5 | 260.0 | 72.60 | 332.60 | 26.9 |
| 3 | 38 | 40 | 252.5 | 73.60 | 326.10 | 26.7 |

Example 8

The same process can be used to find the centers of gravity for woods. The first step, however, is to determine the force for the shortest club in a set. In this case, it would be a 7 wood. The center of gravity for this 7 wood was measured at 30.4 inches from the butt end. Therefore, the force F, measured in grams, can be calculated as shown below:

| Club # (woods) | Playing Length L (inches) | $L_1 = L + d_2$ (inches) | Head weight $M_h$ (grams) | Shaft weight $M_s$ (grams) | Total weight $W = M_h + M_s$ (grams) | Force $F = WL_1/C$ C = 30.4 in (grams) |
|---|---|---|---|---|---|---|
| 7 | 40.4 | 42.4 | 85.86 | 316.06 | 319.06 | 440.4 |

Knowing the force F, the rest of the center of gravity can be calculated for the woods. These calculations are shown below:

CALCULATION FOR CENTERS OF GRAVITY FOR WOODS

| Club # (woods) | Playing Length L (inches) | $L_1 = L + d_2$ (inches) | Head weight $M_h$ (grams) | Shaft weight $M_s$ (grams) | Total weight $W = M_h + M_s$ (grams) | Center of Gravity $C = WL_1/F$ (inches) |
|---|---|---|---|---|---|---|
| 5 | 41.5 | 43.5 | 217.8 | 88.0 | 305.8 | 30.2 |
| 3 | 42.5 | 44.5 | 206.3 | 89.1 | 295.4 | 29.8 |
| 1 | 43.5 | 45.5 | 195.3 | 92.34 | 287.6 | 29.7 |

Process

The process of providing a matched set of clubs, wherein each club in a set includes the same feel and performance, a constant flexural rigidity of each complete iron and each complete wood, constant moment of inertia for each iron and each wood, and the center of gravity as they relate to the swing of the individual golfer, will inherently optimize the performance of the golfer. This process is summarized below:

(a) finding the best "felt" club for determining the proper flexural rigidity. In this step, the golfer swings a series of preset test clubs and decides which one feels the best and provides the best performance. The frequency of the club which felt the best is recorded.

(b) From a series of preset test clubs the distance and/or speed is recorded. Utilizing Table I or Table II, the swing weight or moment of inertia is recorded.

(c) Once the moment of inertia is recorded, the head weight for each club is calculated and recorded by using equation (2).

(d) The clubs are assembled. The frequencies are synchronized and each have the frequency determined and recorded at step (a) for providing for each club to have the same frequency in the set.

(e) The center of gravity is determined and recorded for the shortest club in the set.

(f) Using equation 4, the force is calculated for the shortest club from item (e).

(g) Knowing the force, the center of gravity is calculated and recorded using equation 5 for the rest of the clubs in the set. As the rest of the clubs are gripped, the center of gravity is set by adding the appropriate weight to the butt end of the club via conventional means as necessary to establish the center of gravity in the required location relative to the butt end of the club.

It is noted that the process defined above has worked well on all types and styles of conventional shafts. Consequently providing a method which can work for both tapered and parallel shafts.

While the invention has been particularly shown and described with reference to an embodiment thereof, it will be understood by those skilled in the art that various changes in form and detail may be made without departing from the spirit and scope of the invention.

We claim:

1. A correlated set of golf clubs for use by a golfer, said correlated set of golf clubs comprising:

at least two golf clubs of an equivalent set;

each club includes a shaft having a first end and a butt end;

a head being located at said first end and a grip being located at said butt end;

said head having a head weight;

said plurality of shafts lengths decreases as said head weights increases;

each club has a measured frequency when said head is attached thereto and said measured frequency is established by tip cutting said first end of said shaft, until re-measured frequency equal the established required frequency for the club set being built;

said measured frequency of said plurality of clubs being within plus or minus 1 cycle per minute of said established frequency;

said set of golf clubs includes a base club, said base club is a completed club and includes a first length, said first length is the shortest length in said set of golf clubs, a force (F) is calculated for said base club using the following equation:

$$F = \frac{WL_1}{C};$$

wherein:

C is a measured distance from the center of gravity of said base club to said butt end of said club;

W is a total weight of said head and said shaft of said base club;

$L_1$ is said first length plus $d_2$ for $d_2$ being a point above said butt end of said grip of said base club used as the axis of rotation;

a center of gravity is calculated for each additional club of said set using the following equation:

$$C_n = \frac{W_n L_n}{F}; \quad \text{wherein}$$

$C_n$ is a calculated measurement establishing a location of said center of gravity of club n measured from said butt end of said grip of club n;

$W_n$ is a total weight of said head and said shaft of said club n; and $L_n$ is a length of said club n plus $d_2$ for $d_2$ being a point above said butt end of said grip of said club n used as the axis of rotation.

2. A correlated set of golf clubs as in claim 1, wherein each club has a swing weight which produces an optimum hit, said swing weight represents a moment of inertia (MI), each of said shafts includes said head weight ($M_h$), each of said club includes a playing length (L), each of said shafts includes a weight ($M_s$), each butt end includes a weight ($M_b$), and said head weight ($M_h$) being represented by:

$$M_h = \frac{MI - 1/3\, M_s L_s^2 - 4/3\, M_s L_s + 4/3\, M_s + M_b(d_1 + d_2)^2}{(L + d_2)^2};$$

for $d_1$ being a distance from a center of said butt weight to said butt end of said grip and $d_2$ being a point above said butt end of club used as the axis of rotation.

3. A correlated set of golf clubs as in claim 2 wherein $d_1$ and $d_2$ are equal to 2 inches.

4. A correlated set of golf clubs as in claim 1, wherein said club has a moment of inertia and said moment of inertia is substantially constant for each club and is related to the club head speed generated by the golfer.

5. A correlated set of golf clubs as in claim 4, wherein said moment of inertia (MI) is a swing weight, said swing weight is directly related to a club head speed for providing an optimum performance, each of said clubs includes a playing length (L), each of said shafts includes a weight ($M_s$), each butt end includes a weight ($M_b$), and said head weight ($M_h$) being represented by the following calculation:

$$M_h = \frac{MI - 1/3\, M_s L_s^2 - 4/3\, M_s L_s + 4/3\, M_s + M_b(d_1 + d_2)^2}{(L + d_2)^2};$$

for $d_1$ being a distance from a center of said butt weight to said butt end of said grip and $d_2$ being a point above said butt end of club used as the axis of rotation.

6. A correlated set of golf clubs as in claim 5, wherein $d_2$ is equal to 2 inches.

7. A correlated set of golf clubs as in claim 1, wherein $d_1$ and $d_2$ are equal to 2 inches.

8. A method of designing a correlated set of golf clubs for use by a golfer, wherein each club has a same feel, each golf club in the set has a different length and includes a shaft having a butt end and a first end, and said first end has a head and said butt end includes a grip, said method comprising:

(a) establishing a required frequency for an assembled golf club by tip cutting a first end of a shaft of each club; and (b) providing said frequency of said clubs to be within plus or minus 1 cycle per minute of each other when said club is assembled;

(c) adjusting said assembled frequency to equal said frequency via tip cutting, reattaching said head to said shaft, and re-measuring said assembled club, re-adjusting said length and re-measuring said assembled frequency until said assembled frequency is equal to said recorded selected frequency.

9. A method as in claim 8 wherein there is provided the further step of correlating each club to have a substantially constant moment of inertia.

10. A method as in claim 9 wherein there is provided the further step of calculating a center of gravity which is inversely proportional to a swing force of a golfer, and said center of gravity for each club includes a constant force.

11. A method as in claim 8 wherein there is provided the further steps of:

(c) providing a grip on said butt end and establishing a swing weight which produces an optimum hit and said swing weight represents a moment of inertia (MI);

(d) calculating a head weight ($M_{hn}$) for each club by the equation:

$$M_h = \frac{MI - 1/3\, M_s L_s^2 - 4/3\, M_s L_s + 4/3\, M_s + M_b(d_1 + d_2)^2}{(L + d_2)^2};$$

where, $L_n$ is a playing length of club n, $M_{sn}$ is a shaft weight of club n, $M_{bn}$ is a weight for a butt end of club n, $L_{sn}$ is a length of a shaft of club n, for $d_1$ being a distance from a center of said butt weight to said butt end of said grip and $d_2$ being a point above said butt end of club n used as the axis of rotation.

12. A method as in claim 11 wherein $d_1$ and $d_2$ are equal to 2 inches.

13. A method as in claim 11 wherein there is provided the further steps of:

(e) establishing a base club, said base club includes a first length, said first length is the shortest length in said set of golf clubs (f) calculating a force (F) for said base club using the following equation:

$$F = \frac{WL_1}{C};$$

wherein:

C is a measured distance from a center of gravity of said base club to said butt end of said club;

W is a total weight of said head and said shaft of said base club;

$L_1$ is said first length plus $d_2$ for $d_2$ being a point above said butt end of said grip of said base club used as the axis of rotation;

(g) calculating a center of gravity for each additional club of said set using the following equation:

$$C_n = \frac{W_n L_n}{F};$$

wherein $C_n$ is a calculated measurement establishing a distance from said butt end from club n of said set to said center of gravity of club n;

$W_n$ is a total weight of said head and said shaft of said club n; and $L_n$ is a length of said club n plus $d_2$ for $d_2$ being a point above said butt end of said grip of said club n used as the axis of rotation.

14. A method as in claim 8 wherein there is provided the further steps of:

(d) selecting a base club, said base club includes a first length;

(e) calculating a force (F) for said base club using the following equation:

$$F = \frac{WL_1}{C};$$

wherein:

C is a measured distance from a center of gravity of said base club to said butt end of said club;

W is a total weight of said head and said shaft of said base club;

$L_1$ is said first length plus $d_2$ for $d_2$ being a point above said butt end of said grip of said base club used as the axis of rotation;

(f) calculating a center of gravity for each additional club of said set using the following equation:

$$C_n = \frac{W_n L_n}{F};$$

wherein $C_n$ is a calculated measurement establishing a location of said center of gravity of club n measured from said butt end of said grip of club n;

$W_n$ is a total weight of said head and said shaft of said club n; and $L_n$ is a length of said club n plus $d_2$ for $d_2$ being a point above said butt end of said grip of said club n used as the axis of rotation.

15. A method of matching a correlated set of golf clubs to a particular golfer, wherein each club has a same feel for said particular golfer, each golf club in the set has a different length and includes a shaft having a butt end and a head end, and said head end has a head, said method comprising:

(a) finding a club of the best accuracy, distance, and trajectory from a set of preset test clubs for determining a proper flexural rigidity;

(b) recording a frequency from said best felt club;

(c) establishing a best swing weight;

(d) recording said swing weight for conversion to a moment of inertia;

(e) calculating a head weight ($M_{hn}$) using said moment of inertia MI for each club by the equation:

$$M_h = \frac{MI - 1/3\, M_s L_s^2 - 4/3\, M_s L_s + 4/3\, M_s + M_b(d_1 + d_2)^2}{(L + d_2)^2};$$

where, $L_n$ is a playing length of club n, $M_{sn}$ is a shaft weight of club n, $M_{bn}$ is a weight, including said grip added to said shaft for a butt end of club n, $L_{sn}$ is a length of a shaft of club n, for $d_1$ being a distance from a center of said butt weight to said butt end of said grip and $d_2$ being a point above said butt end of said club n used as the axis of rotation;

(f) assembling each club by attaching a head to a first end of a shaft and measuring an assembled frequency;

and (g) adjusting said assembled frequency to equal said frequency via tip cutting, reattaching said head to said shaft, and re-measuring said assembled club, re-adjusting said length and re-measuring said assembled frequency until said assembled frequency is equal to said recorded selected frequency.

16. A method as in claim 15 wherein there is provided the further steps of:

(h) selecting a base club, said base club includes a first length;

(i) calculating a force (F) for said base club using the following equation:

$$F = \frac{WL_1}{C};$$

wherein:

C is a measured distance from a center of gravity of said base club to said butt end of said base club;

W is a total weight of said head and said shaft of said base club;

$L_1$ is said first length plus $d_2$ for $d_2$ being a point above said butt end of said grip of said base club used as the axis of rotation;

(j) calculating a center of gravity for each additional club of said set using the following equation:

$$C_n = \frac{W_n L_n}{F};$$

wherein $C_n$ is a calculated measurement establishing a distance from said butt end of club n of said set to said center of gravity of club n;

$W_n$ is a total weight of said head and said shaft of said club n; and $L_n$ is a length of said club n plus $d_2$ for $d_2$ being a point above said butt end of said grip of said club n used as the axis of rotation.

17. A method as in claim 16 wherein $d_1$ and $d_2$ are equal to 2 inches.

* * * * *